US005671868A

United States Patent [19]

Herr

[11] Patent Number: 5,671,868

[45] Date of Patent: Sep. 30, 1997

[54] FLUID DISPENSING CONTAINER EQUIPPED WITH A FUNNELED SIDEWALL SECTION AND A VALVED POURING SPOUT

[76] Inventor: Boone D. Herr, 6444 NE Going, Portland, Oreg. 97218

[21] Appl. No.: 484,492

[22] Filed: Jun. 7, 1995

[51] Int. Cl.[6] ..... B67D 3/00

[52] U.S. Cl. ..... 222/1; 141/1; 222/534; 222/536

[58] Field of Search ..... 222/534, 536, 222/1, 460, 461; 141/1

[56] References Cited

U.S. PATENT DOCUMENTS

| | | | |
|---|---|---|---|
| 344,975 | 7/1886 | Miller | 222/536 |
| 470,838 | 3/1892 | Hart | 222/534 |
| 473,325 | 4/1892 | Merrill | 222/534 X |
| 508,730 | 11/1893 | Lynn | 222/536 |
| 515,552 | 2/1894 | Phelps | 222/534 |
| 519,534 | 5/1894 | James | 222/536 X |
| 521,113 | 6/1894 | Hart | 222/534 X |
| 860,276 | 7/1907 | Beman | 222/536 X |
| 1,417,951 | 5/1922 | Staples et al. | 222/534 |
| 1,500,347 | 7/1924 | Stubbers | 222/536 X |
| 1,514,944 | 11/1924 | Wiswell | 222/536 |
| 1,555,176 | 9/1925 | Allen . | |
| 1,558,985 | 10/1925 | Howell | 222/534 X |
| 2,021,411 | 11/1935 | Garrison | 222/534 X |
| 4,298,038 | 11/1981 | Jennings | 141/2 |
| 4,645,099 | 2/1987 | Gillispie et al. | 222/472 |
| 4,746,036 | 5/1988 | Messner | 222/484 |
| 4,811,870 | 3/1989 | Bianco | 222/461 |
| 4,834,270 | 5/1989 | Messner | 222/484 |

*Primary Examiner*—Kevin P. Shaver
*Attorney, Agent, or Firm*—M. Paul Hendrickson

[57] ABSTRACT

The present invention provides a fluid dispensing container which more effectively regulates and controls fluids dispensed from the container. The container includes a unique funneling and valve assembly which funnels fluid from the container to a valved pouring spout. The container provides a unique fluid flow through an apertured tubular conduit to which the spout is pivotally mounted. Pivoting the spout opens and closes the valve assembly. The fluid flows through both ends of the tubular conduit, and as a result, the fluid flows more smoothly and uniformly from the container to the spout.

20 Claims, 4 Drawing Sheets

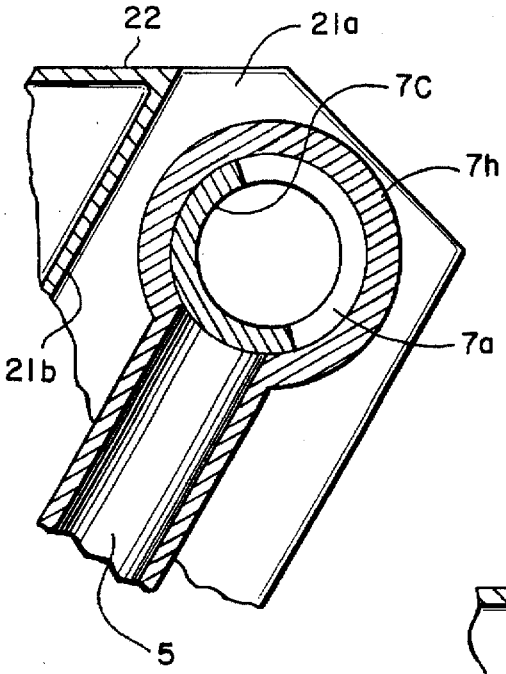
FIG. 6
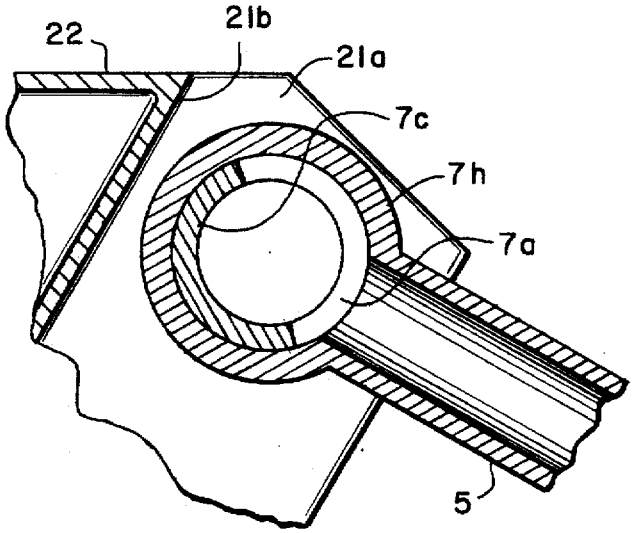
FIG. 7
FIG. 8
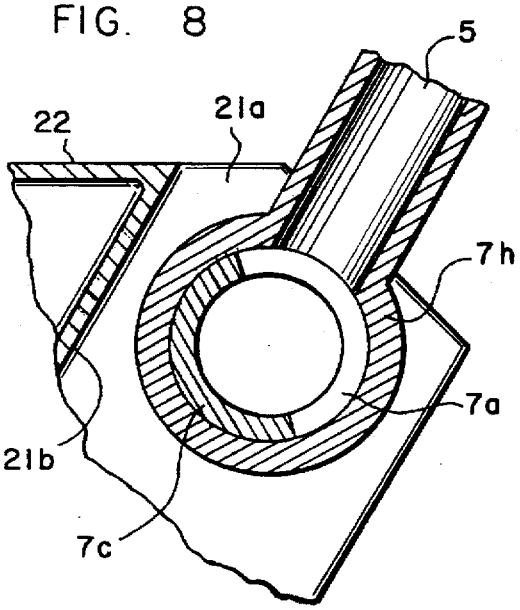
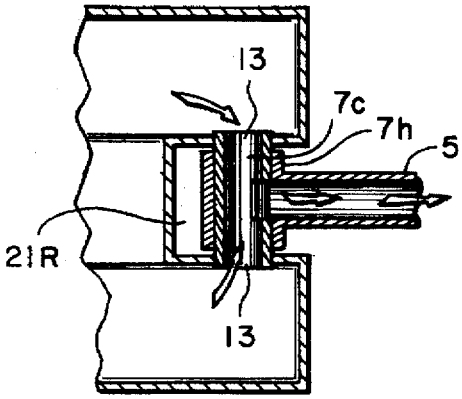
FIG. 9

FLUID DISPENSING CONTAINER EQUIPPED WITH A FUNNELED SIDEWALL SECTION AND A VALVED POURING SPOUT

FIELD OF THE INVENTION

The present invention relates to containers and more particularly to fluid dispensing containers and their use.

BACKGROUND OF THE INVENTION

Dispensing fluids from a dispensing container into a fluid-receiving receptacle can often be an arduous and unsafe task. Such a task is typified by the pouring of a fluid such as gasoline from a fuel can into a fuel tank. Most fluid dispensing containers require a titling of the container sidewise with the spout pointing downwardly which allows the fuel to flow through the pouring spout into the fuel tank. Control over the flow rate and the amount of fuel dispensed from the container can be difficult, especially when refueling involves a small fuel tank. The person using the dispensing container must conduct a number of simultaneous operations and dextrous manipulations in order to properly dispense the fluid from the container to the fuel tank. Typically the fuel tank will be overfilled or underfilled since it is most difficult to precisely regulate the amount of fluid dispensed from the container. Once the fluid flow is set in motion excess fluid readily collects and moves through the pouring spout. Consequently, a rapid movement of the container to stop the fluid flow by a repositioning the container to a non-pouring position often fails to correct an overfill. Flammable fluid overflows are hazardous.

The older fuel dispensing containers were often equipped with a flexible metal pouring spout which could be more readily adjusted to any appropriate pouring position which, in turn, permitted for a more accurate control over-fluid flow especially when compared to the more current styled pouring spouts. It is also conventional practice to equip the dispensing container with a pouring spout which can be removed and stored within the container when not in use and remounted at a pouring position for refueling. Many fluid dispensing containers are equipped with a rigid spout while others rely upon semi-flexible plastic or rubber pouring nozzle. In cold weather the plastic pouring spouts become relatively hard, inflexible and difficult to manipulate. However, whatever dispensing container may be utilized to transfer a fluid to a receiving receptacle such as a fuel tank, current dispensers show little, if any, improvement over those which existed several decades ago. In fact, some of the older fuel dispensing containers performed much more satisfactory than the current plastic dispensing containers.

A need exists for a fluid dispensing container which permits fluids to be dispensed from the container at a controlled rate and more effectively than existed with the prior art dispensers. A need exists for a container which may be appropriately positioned at an optimum pouring position so as to permit a more effective transfer of the fluid from the dispensing container to the receiving receptacle while also allowing for a more responsive cessation of the fluid flow. There is a further need for a container for dispensing fluid in which the pouring spout may be more effectively inserted into the receptacle adjusted to a pouring position and appropriately stopped from further discharge when desired. A further need exists for a fluid dispensing container which dispenses fluid more expeditiously, uniformly and constantly than existing dispensing devices.

BRIEF DESCRIPTION OF THE DRAWINGS

FIG. 6 is an expanded partial cross-sectional view of the valve assembly shown in FIG. 3 positioned at a closed valve position.

FIG. 7 is another expanded cross-sectional view of the valve assembly and pivotal spout of FIG. 6 repositioned to an open fluid dispensing position.

FIG. 8 is another view illustrating the valve assembly of FIG. 6 repositioned to another open fluid dispensing position.

FIG. 9 is an expanded partial view of the container taken along line 4—4 of FIG. 2 depicting the fluid flow through the pouring spout and valve assembly when positioned in an open valved and fluid dispensing position.

SUMMARY OF THE INVENTION

Figure 1:
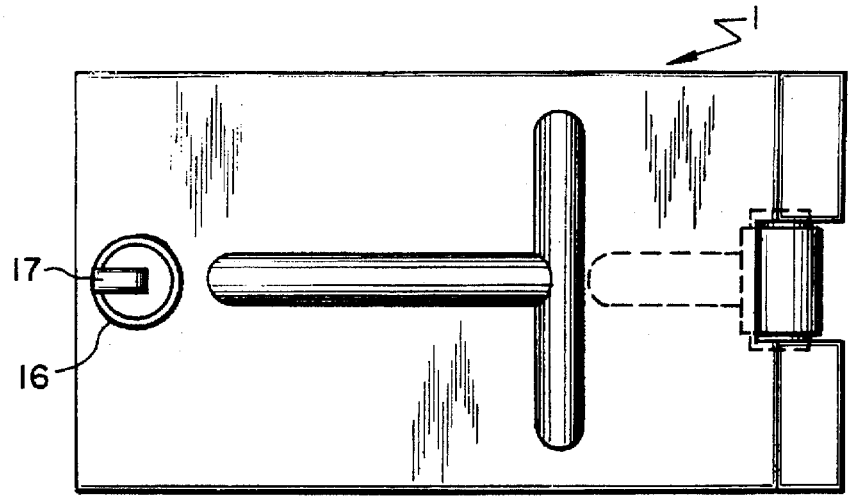
FIG. 1 is a top view of a fluid dispensing container of this invention with the broken lines depicting an occluded view of a pivotally mounted pouring spout positioned at a closed valve position as further illustrated in FIGS. 2–3 and 6.

The present invention provides a dispensing container equipped to more effectively dispense fluids from the container. The container includes a valved spout assembly which regulates fluid flow by pivotal movement of a pivotally mounted spout. The container includes a hollow body portion defining an enclosed container equipped with a valved assembly responsively connected to the pivotally mounted pouring spout. A sidewall section of the dispensing container includes a recessed channel for receiving and retaining the spout when pivotally positioned to a closed valve position. An internally open tubular conduit bridging across the channeled recess provides a tubular passageway communicating at both open ends of the conduit onto the hollow container. The tubular conduit, thus, serves as a site for pivotal mounting of the pouring spout while also permitting the fluids to flow smoothly and uniformly from within the container through the valve assembly and onto the pouring spout.

The pouring spout is constructed of elongated tubular material of sufficient rigidity so as to permit its pivotal movement about the tubular conduit. The elongated spout is open at one end for discharging fluids therethrough and communicating onto a cylindrical housing transversely extending across at the opposite spout end. The cylindrical housing and pouring spout form a T-shaped fluid passageway. The cylindrical housing is sized so as to concentrically mate onto the tubular conduit and cooperatively permit pivotal movement of the attached cylindrical housing about the tubular conduit.

The tubular conduit is provided with a slotted aperture which serves as a valved outlet when the slotted aperture is placed in alignment to the tubular passageway of the spout. Thus, by appropriate adjustment of the pouring spout to an open valved position by aligning the slotted aperture onto the inlet passageway of the pouring spout, the fluid is allowed to flow from the container through the tubular conduit, the slotted aperture and onto the spouting spout. When the pouring spout is pivotally adjusted so that the slotted aperture seats onto a solid region of the cylindrical homing the pouring spout passageway is seated at a closed valved position. The discharging of fluids from the container may be, accordingly, effectively regulated by a pivotal movement of the pouring spout to a closed valve position when desiring to stop the fluid flow and an opening of the valve assembly by pivotally moving the pouring spout to an open valved position when desiring to dispense fluid from the container.

The configuration of the container may also be utilized to advantage in dispensing of fluids from the container. The container configuration permits a funneling of fluids within the container to the pouring spout to enhance fluid flow and fluid discharge. Upon pivotal movement of an open valved position to the pouring spout, a container configuration funnels fluids to the pouring spout to facilitate fluid discharging from the container. This cooperative arrangement is accomplished by pivotally mounting the pouring spout to a sidewall section at a confluent flow position for funneling the contained fluids to the pouring spout when the container is positioned to a pouring and fluid dispensing position. A sidewall section structured to create an acute angular projection converging onto the pivotal mounted spout effectively funnels the fluids onto the pouring spout. A slanted sidewall section extending upwardly and outwardly from a container base and channeled so as to converge upon a pivotally mounted spout mounted along an upper region of the sidewall section provides a particularly efficient container for funneling and discharging fluids to the spout.

The fluid dispensing container of this invention provides a more effective means for regulating and controlling fluids dispensed from a container. This may be simply accomplished by positioning the container to a fluid dispensing position and adjusting the pivotally mounted spout to an open valved position. Fluid may be easily and safely dispensed from the container. The design of the container effectively funnels the fluids to the pouring spout. When it is desired to stop the fluid discharge, the container and pivotally mounted pouring spout are repositioned to stop the fluid flow. Inadvertent spillage of hazardous fluids can be effectively alleviated by manually regulating the fluid flow by proper positioning of the container and pivotal manipulation of the pouring spout. Since the container and pivotally mounted spout are unitarily integrated into a cooperative structure, the container provides for a coordinated manipulation and a significantly enhanced regulation of the fluid flow. The use of two ports for discharging fluids onto the tubular conduit bridging between the recessed channel of the sidewall section in combination with the funneling structure affords a more expeditious, uniform and constant discharge of fluids from the container. The valve assembly is integrated into the dispensing container as to be responsively sensitive to a pivotal movement of the pouring spout which in turn a more accurate and controllable means for dispensing fluids from the dispensing container. Regulation of fluid flow during the discharging of fluids from the container can be effectively controlled by regulating air flow vented into the dispensing container.

DETAILED DESCRIPTION OF THE INVENTION

Figure 10:
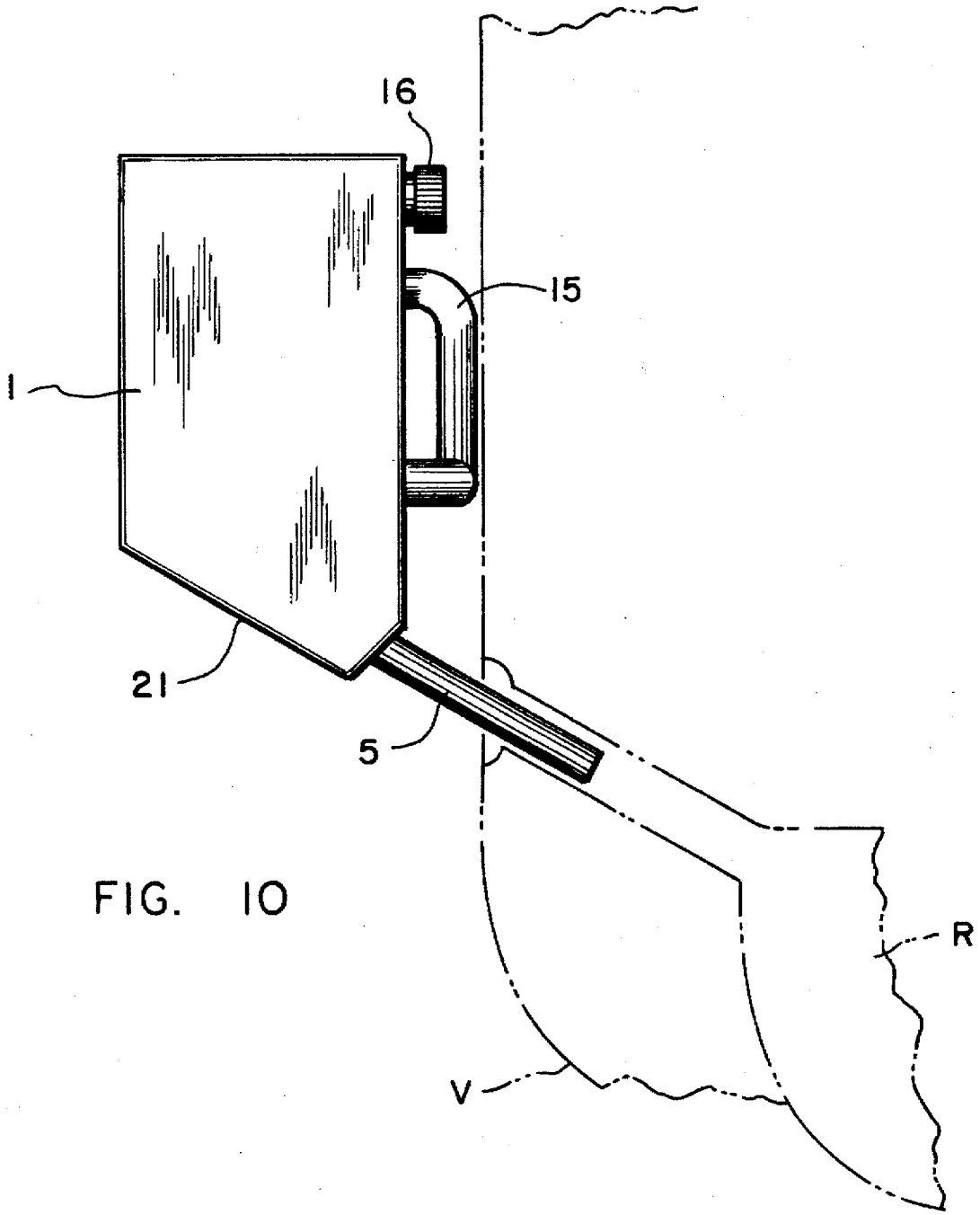
FIG. 10 is a side view of the dispensing container of FIG. 1 and a partial cross-sectional depictation of an automotive fuel tank illustrating the use of the container in dispensing fluid with the valve assembly being positioned as shown in FIG. 8.

With reference to FIGS. 1–10 which depict the preferred embodiments of the invention, there is provided pursuant to the present invention a dispensing container (generally designated as 1) equipped to more effectively regulate a dispensing of fluid F from the container 1 by pivotal movement of a spouted valved assembly (generally designated as 7). In general, the container 1 comprises an enclosed body portion 2 for housing the fluid F within the container 1. A pouring spout 5 is pivotally mounted to the body portion 2 at a confluent flow position. Valve assembly 7 is responsively interconnected to the pivotally mounted spout 5 so that pivotal movement of the pouring spout 5 in relation to fluid F level container within the body portion 2 affords a more accurate regulation of the fluid F being discharged from container 1. Upon pivotal movement of the pouring spout 5 to an open valved dispensing position (as shown in greater detail by the cross-sectional views of FIGS. 7–9) fluid F may be effectively discharged from container 1. Pivotal movement of the spout 5 and the operationally associated valve assembly 7 to the closed valve position (as shown in greater detail by the cross-sectional views of FIGS. 3 and 6) blocks fluid F flow to spout 5. Simply by inserting the pouring spout 5 into the receiving receptacle R, as illustrated in FIG. 10, pivotally adjusting the container 1 and pouring spout 5 to the open valved dispensing position (as depicted by FIG. 10), the desired mount of fluid F at the desired rate of flow may be effectively regulated. Terminating fluid flow may be simply accomplished by repositioning the container 1 so as to cause the pouring spout 5 to also become repositioned at the closed valved position of FIG. 6. Repositioning of container 1 so that the fluid F level rests below the pivotal mount of pouring spout 5 will also serve to stop the fluid F discharge.

The body portion 2 may be of any suitable configuration for dispensing liquids (e.g. spherical, cylindrical, polygonal, etc.), however, the depicted planer or trapezoidal configuration affords advantages over conventionally configured containers. The enclosed hollow body portion 2, depicted in the Figures, comprises enclosing walls (designated as a 20 series numbering), namely sidewall section 21, top wall 22, right wall 23, left wall 24, base wall 25, and rear wall 26.

The body portion 2 also preferably includes an internally disposed funnel section 9 which funnels the fluid F within the container 1 towards pouring spout 5. The container fluid F is positioned to a pouring position such as depicted by FIG. 10. Although the container 1 may rely upon various different configurations which funnel the fluid F towards pouring spout 5, a body portion 2 equipped with enclosing walls 21–25 which forms an internally disposed funnel section 9 converging onto the pouring spout 5 may be used to particular advantage for this purpose. Funneling section 9 is depicted as being comprised of two separated funneling compartments, namely a left funneling compartment $9_L$ and a right funneling compartment $9_r$.

As depicted in the preferred embodiments of the drawings, the hollow body portion 2 includes a sidewall section 21 which in relationship to top wall 22, base wall 25, left wall 24, and right wall 23 creates or forms funneling section 9 for funneling the contained fluids F to pouring spout 5. In the depicted container 1, the funneling sidewall section 21 includes a left funneling sidewall section $21_L$ and a right funneling sidewall section $21_r$ which, in relation to base section 25, extends upwardly and outwardly to its joinder with top panel section (generally designated as 22).

The funneling sidewall section 21 includes a recessed channel (generally designated as 21R) sized to house pivotally mounted spout 5 when retracted within channel 21R as depicted by FIGS. 1–4 and 6. Channel recess 21R is a recessed region formed by margining left channel wall **21*a*, right channel wall 21***c*, and base channel wall 21*b*. The left channel wall 21*a* and right channel wall 21*c* are equipped with outlet ports 13 which serve as fluid discharge ports for discharging fluids F from hollow body portion 2 and as a mounting site for tubular conduit 7*c*. As will be explained more fully later, spout 5 when pivotally retracted within channel 21R shuts off the fluid flow and closes valve assembly 7 from fluid discharge. Recessed channel 21R includes two laterally spaced ports 13 which serve as dual ported outlets for discharging fluids onto tubular conduit 7*c*. Conduit 7*c* bridges across channel 21R and interconnects onto dual ports 13 so as to provide a continuous or looped fluid passageway from within body portion 2 onto spout 5. The looping of tubular conduit 7*c* equalizes fluid flow to pouring spout 5 which in turn causes the fluid discharge to be more uniform. The looping is also believed to contribute towards the ability to control fluid flow by regulating the amount of air vented into hollow body section 2 through air vent 17.

Figure 3:
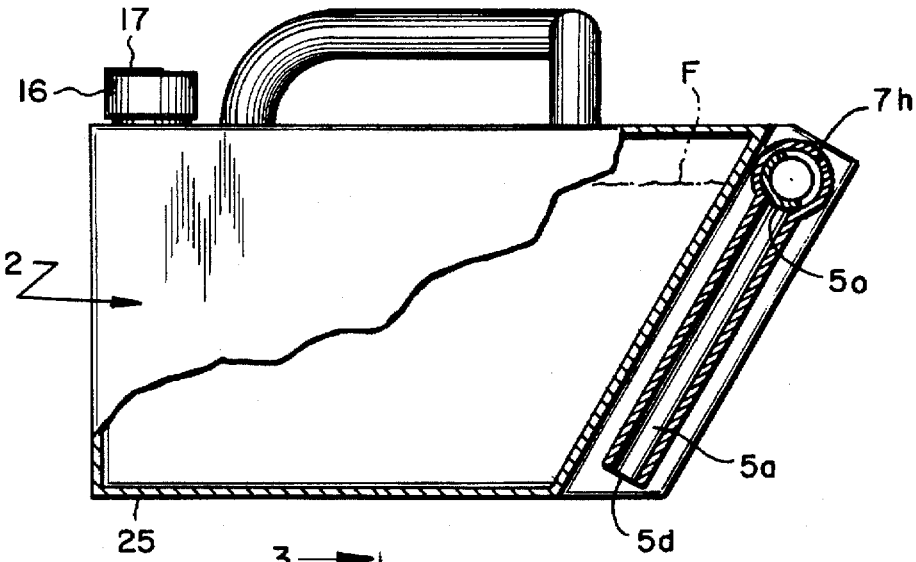
FIG. 3 is a cross-sectional view of the fluid dispensing container taken along line 3—3 of FIG. 2.
Figure 2:
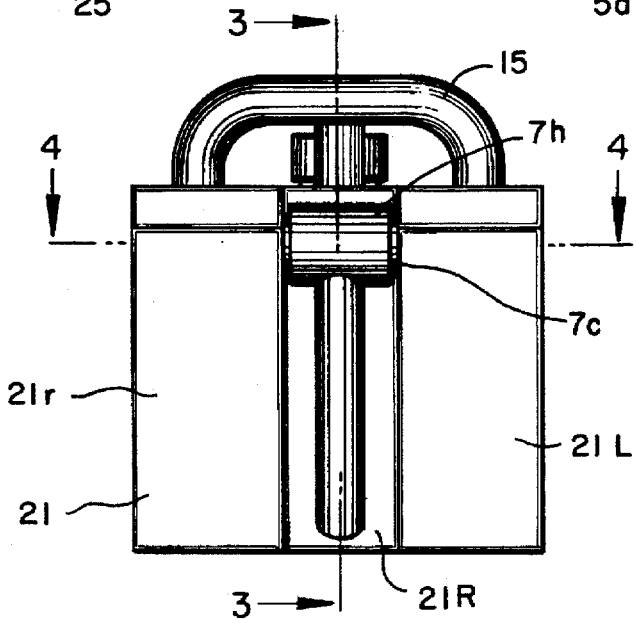
FIG. 2 is a frontal view of the fluid container shown in FIG. 1.
Figure 4:
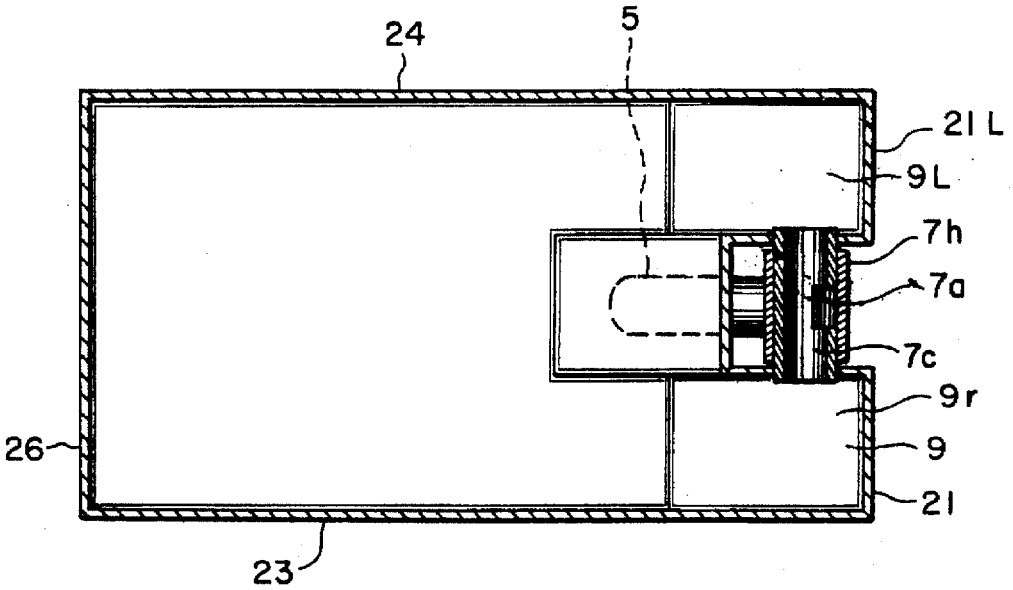
FIG. 4 is a cross-sectional view of the fuel container taken along line 4—4 of FIG. 2.

Tubular conduit 7*c* serves multiple functions. Tubular conduit 7*c* serves as a looped conduit for conducting fluids from container 1 through ports 13, valve assembly 7 and onto spout 5. Tubular conduit 7*c* also provides a pivotal mounting site for pivotally mounting spout 5 to container 1. Tubular conduit 7*c* includes a valving aperture 7*a* which, when aligned onto passageway 5*a* of spout 5 (as depicted by cross-sectional FIGS. 7–9) provides a communicating passageway for discharging fluids from container 1. When passageway 5*a* of pouring spout 5 becomes aligned onto a non-apertured or solid tubular portion of tubular conduit 7*c* as illustrated by FIGS. 3, 4 and 6, valve assembly is closed.

Pouring spout 5 is constructed of elongated tubular material so as to provide a spouted passageway. Spout 5 should possess sufficient structural rigidity so as to permit axial movement about the tubular conduit 7*c*. The elongated spout 5 is open at a discharging end 5*d* for discharging fluids therethrough with an opposite inletting end 5*o* openly communicating onto a cylindrical housing 7*h* which transversely extends across the opposite spout end. The cylindrical housing 7*h* and pouring spout 5 form a T-shaped fluid passageway. The cylindrical housing 7*h* is sized to as to concentrically mate onto the tubular conduit 7*c* and cooperatively permit pivotal movement of the attached cylindrical housing 7*h* and the connected pouring spout about the tubular conduit 7*c*.

Tubular conduit 7*c* is provided with a slotted aperture 7*a* which serves as a valved outlet when the slotted aperture 7*a* is placed in alignment to the tubular passageway 5*a* of the spout 5. Thus, by appropriate adjustment of the pouring spout 5 to an open valved position by aligning the slotted aperture 7*a* onto the inlet passageway 5*o* of pouring spout 5 (as illustrated by the cross-sectional views of FIGS. 7–9), the fluid F is allowed to flow from the tubular conduit 7*c* through the slotted aperture 7*a* for discharging from pouring spout 5. When the pouring spout 5 is pivotally adjusted to that the slotted aperture 7*a* seats onto cylindrical housing 7*h* (i.e. at a closed valved position), inlet pouring spout passageway 5*o* will also seat totally against a solid or unslotted portion of the tubular conduit 7*c* so as to block fluid passage to the pouring spout 5. As depicted by the Figures, the discharging of fluids F from the container 1 may be controlled by pivotal movement of the pouring spout 5 to a closed valve position of FIG. 6 when desiring to stop the fluid flow and, when desiring to dispense fluid F from the container 1, an opening of the valve assembly 7 by pivotally moving the pouring spout 5 to an open valved position, as illustrated by FIGS. 7–9. A pivotal pouring spout 5 about valved 7 will advantageously provide an open valved position over a pivotal are of at least 45 degrees and most advantageously at more than 90 degrees.

In the preferred embodiments of the invention, valve assembly 7 will typically provide an open valve positioning by pivotal movement, as depicted by the drawings, over an are ranging from about 160 to about 200 radial degrees and most preferably about 185 degrees plus or minus 5 degrees. By referring to the cross-sectional view of the preferred embodiment of valve assembly 7 as depicted by FIGS. 6–8, valving aperture 7*a* forms an are amounting to about 185 radial degrees of the total 360 are degrees afforded by conduit 7*c*. Pivotal movement of pouring spout 5 about an are of the 185 degrees, thus affords an open fluid passageway or open valve position (as illustrated by FIGS. 7–9) through valving aperture 7*a*, pouring spout 5 and inlet passageway 5*a* for the discharging of fluids therethrough. When spout inlet passageway 5*a* is pivoted so as to fully seat inlet 5*a* against solid section of 7*c* as depicted in FIG. 6, the valve assembly 7 will be closed. The ability to dispense fluid F by pivotally positioning pouring spout 5 throughout a 185 degree arc affords numerous spout 5 positioning for effectively dispensing fluids F from container 1. It should also be self-evident from FIGS. 6–9 that when inlet 5*a* of pouring spout 5 is adjusted so as to partially align but be completely align onto aperture 7*a*, the valve assembly 7 will not be completely open to fluid passage. The fluid discharge rate will, accordingly, diminish as the inlet opening 5*a* for fluid flow diminishes. Thus, along both of the radial margins of aperture 7*a* which border onto the solid section of conduit 7*c* there exists a slower fluid discharge rate than when valve assembly 7*a* is positioned to the fully opened position as depicted by FIGS. 7–9.

As may be further observed from the figures, radially mounted pouring spout 5 may be swung clockwise until it rests against recessed wall 21R and counterclockwise until it rests against the vortex of recessed wall 21R and top wall 22. In the container 1 depicted by the figures, the particular container design affords about a 240 degree arc for the pivotal movement of pouring spout 5, of which 185 degrees represent an open valved position while about 55 degrees of the spout 5 movement places spout 5 in the closed valve position. When the container 1 is placed at fluid dispensing position, such as depicted in FIG. 10, closure of the valve assembly 7 may be readily effectuated simply by lowering container 1 so as to cause the pouring spout 5 when lowering container 1 to pivot to a closed valve position as illustrated by FIG. 6. The fluid flow will initially become terminated when the positioning of fluid F at a level below ports 13. The mount of fluid in container 1 will affect at which juncture the lowering of container 1 will terminate fluid flow.

The depicted body portion 2 of container 1 includes a right funneling sidewall section $\mathbf{21}_r$ which includes two segments 22*s* which are tapered and a left funneling sidewall section $\mathbf{21}_L$ in juxtaposition to their joinder to top wall member 22. The tapering internal structure provided thereby defines internally disposed funnel section 9 which, when the container is positioned to a pouring position as illustrated in FIGS. 9 and 10, more completely funnels the fluid F to ports 13 and spout 5.

Top panel section 22 is provided with a handle 15 which may be used to carry and position container 1 to the proper pouring position. The depicted handle 15 is hollow and communicates onto the body portion 2. Refill cap 16 provides fluid refilling access to container and is provided with air venting means 17 for venting and controlling fluid flow rate when dispensing fluid from the container.

Side panel sections 23 and 24 and rear panel sections 26 complete the hollow body portion 2 enclosure for container 1. Although body portion 2 may be of a wide variety of shapes and configurations, planar surfaces, as opposed to circular configurations provides a dispensing container which may be more effectively positioned in a fluid dispensing position. As may be observed from FIGS. 3, 5, and 10, side panels 24 and 25 are positioned at acute angular relationship to top wall 22 and sidewall 21 forms a funneled relationship thereto for allowing fluids to be funneled into ports 13.

Figure 5:
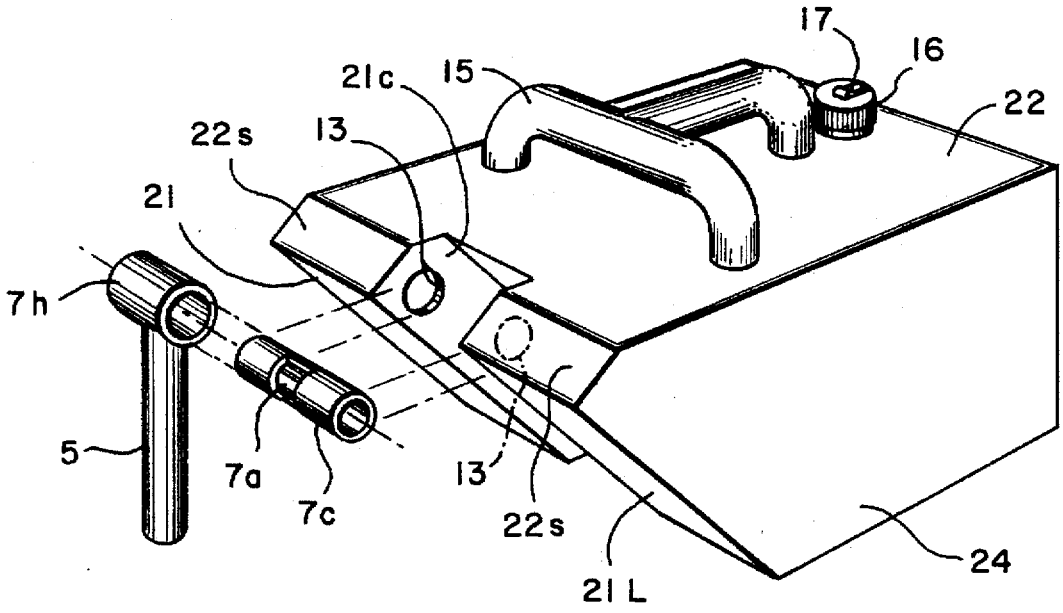
FIG. 5 is a side elevational view depicting in detail unassembled components of the pouring spout and valve assembly of the fluid dispensing container shown in FIG. 1.

As mentioned above, container 1 includes a unique cooperative combination of components which uniquely enables the user to more accurately control the discharge of fluids. Although the flow rate may be controlled by adjusting the valve assembly 7 to a partially open position or by adjusting the container so that the fluid level falls below ports 13, the preferred embodiment of container 1 includes controlling fluid flow by regulating the amount of air vented into container 1. Thus, in the preferred embodiments, the container 1 includes air venting means (generally represented as 17) for regulating the amount of air admitted to container 1 while discharging a fluid from the container 1. In conventional fluid dispensing containers, a single passageway from the container to the spout discharge is relied upon for discharging fluids from the container. Insufficient air venting usually creates an uneven and uncontrollable fluid discharge rate. The presence of two or more discharging ports 13 in cooperative association with controlled air alleviates the gurgling and uncontrollable fluid discharge rate typically encountered with prior dispensing containers. In the preferred embodiments of the invention as illustrated by FIGS. 1, 3, and 5, cap 16 includes a conventional air venting means (namely, air vent 17) and includes a conventional vent through adjustment or positioning of vent 17 which controls the amount of air vented into container 1 while discharging fluids therefrom. A simple screw valve assembly (not shown) in which air flow into container may be regulated by screwing an air valve assembly to a variable open or closed position may also be used for this purpose. More simply, valving the air flow by positional placement of a finger or thumb over the vent to control the air inflow into the container 1 may be utilized to control venting. The present invention allows for controlling fluid discharge by controlling the amount of air vented into container 1 when discharging fluids therefrom. A small inlet rate of air will afford a uniform and constant slow discharge of fluid F from container 1. Conversely, a fully opened venting assembly 17 allows for a uniform and fast rate of fluid discharge from the container 1.

The container may be constructed of a wide variety of materials (e.g. metals, plastics, etc.) by a variety of fabricating techniques. If desired, blow molding techniques may be utilized to fabricate the container I from thermoplastic materials. Similarly, metal or plastic panel sections cut from flat plastic or metal sheets, welded, fused or connected together. The tubular conduit **7*c* and pivotally mounted spout 5 may be appropriately inserted into ports 13 and glued or fused thereto so as to provide the depicted valved assembly 7 and pivotally mounted spout 5. The tubular conduit 7*c* and cylindrical housing 7*h* sealed against seepage or loss of fluid F about the valve assembly 7. Appropriate sizing tubular conduit 7*c* and housing 7*h* so as to seal against seepage or fluid loss can be used to accomplish this objective. If desired, ringed gaskets may be inserted about conduit 7*c* between housing 7*h* ends and channel 21R so as to externally seal housing 7*h*** from any fluid seepage therefore.

The present invention provides a unique method for transferring to a receiving receptacle R a fluid F contained within a dispensing container 1 equipped to regulate fluid flow upon pivotal movement of a pivotally mounted pouring spout 5 responsively connected to a valve assembly 7 so that upon pivotal movement of the pouring spout 5 to an open valve position permits fluid F to be dispensed from said container 1 and upon movement of the spout 5 to a closed valve position terminates the fluid flow therefrom, wherein the container 1 comprises a hollow body portion 2 for housing the fluid F within the container 1, enclosing walls including an internally disposed and outwardly projecting funneled sidewall section 21 for outwardly funneling of the fluid F therewithin when the container 1 is tilted towards the flameled sidewall section 21, with the pouring spout 5 via housing **7*h* being pivotally mounted to the funneled sidewall section 21 at a confluent flow position, said method comprising inserting the pouring spout 5 into the receiving receptacle R, pivotally adjusting the pouring spout 5 to the open valve position, transferring fluid F from said dispensing container 1 to said receiving receptacle R and terminating the fluid flow by movement of the pouring spout 5** to the closed valve position.

The unique method afforded by this invention is particularly adapted for use with a dispensing container 1 in which a flow of a fluid F from the dispensing container 1 may be controlled by pivotal movement of a pouring spout 5, wherein the container comprises a hollow body portion 2 having a bottom wail 25, a top wall 22 and a sidewall 21 defining an enclosure for containing the fluid F within the container 1, said sidewall 21 including an acute angular sidewall section 21 projecting outwardly from the body portion 2 for funneling the fluid F to the pouring spout 5 when the container 1 is tilted towards said angular sidewall section 21, with the sidewall section 21 including a recessed channel 21R equipped with fluid discharge ports 13 oppositely positioned along said channel 21R at a confluent flow position when said container 1 is positioned in a pouring position by tilting the container 1 towards the funneled sidewall section 21, a valve assembly 7 having a valve assembly 7 connected to pouring spout 5 for controlling fluid flowing within said spout 5, with said valve assembly 7 being responsively terminated by the movement of said spout 5, a tubular conduit **7*c* equipped with a discharging orifice 7*a* bridging between the ports 13 and open to the flow of the fluid F therethrough from the body portion 2, a pouring spout 5 pivotally mounted within said recessed channel 21R at the confluent fluid flow position, said pouring spout 5 being equipped with a transversely extending concentric tube 7*h* for axially mounting onto the tubular conduit 7*c* so as to permit pivotal movement of the pouring spout 5 about the conduit 7*c*, with said concentric tube 7*h* including a valve outlet orifice which mates onto the discharging orifice upon the pivotal movement of the spout 5 to an open valve position and a stopping of the fluid F flowing therefrom upon the pivotal movement of the spout 5 to the closed valve position and an air vent 17 communicating from an outside air source to the body portion 2 for regulating air vented into container 1** said method comprising:

a) placing the pouring spout 5 in communication with a fluid receiving receptacle R;

b) elevating the container 1 to the confluent flow position by maintaining the spout 5 in communication with the receptacle R so as to cause the spout 5 to pivotally move and place the valve assembly 7 at the open valved fluid discharging position;

c) dispensing fluid F from said container 1; and d) terminating the dispensing of fluid from said container 1 by implementing at least one subsequent step comprising:

I) lowering the container 1 so that fluid F level within the container 1 is below the fluid discharge ports 13;

II) adjusting the container 1 so as to cause the pouring spout 5 to pivotally move the valve assembly 7 to the closed valve position; and III) stopping the air vented through the air vent 17 into the container.

In the aforementioned method the lowering of container 1 while maintaining the pouring spout 5 engagedly anchored to the fluid receiving receptacle R as shown in FIG. 10 will result in lowering the fluid level below ports 13 while also causing spout 5 to pivotally move sufficiently to close valve assembly 7, thus both I and II steps above can be accomplished thereby. As previously mentioned, the fluid flow rate can be adjusted to a higher flow rate by swiveling the container 1 so as to thereby increase fluid pressure while lowering decreased fluid pressure and, thus, flow rate. Fluid flow rate may also be controlled by regulating the rate of air flow through air vent 17. Decreased air flow will decrease fluid flow while air increase in air flow within the container 1 increases the fluid flow.

What is claimed is:

1. A method for dispensing a fluid from a dispensing container equipped with an enclosed body for containing the fluid within the container with said body including a funneled sidewall section projecting upwardly and outwardly at an angular position so as to permit funneling of the fluid towards an upper region of the funneled sidewall section when the container is adjusted to a pouring position, an air vent for venting air into the enclosed body, a valved assembly communicating onto the upper region of said funneled sidewall section, an axial mount for pivotally mounting the valved assembly to the upper region of the sidewall section, with said assembly operatively controlling the flow of the fluid through the assembly by a pivotal movement of the assembly to an opened valved position and by adjusting the container to the pouring position which allows for the dispensing of fluid through the assembly and by the pivotal movement of the assembly to a closed valved position which terminates fluid flow, and a pouring spout affixed to said valved assembly for pouring the fluid discharged from said valved assembly, said method comprising:

a) positioning said pouring spout in communication with a fluid receiving receptacle;

b) pivoting the valved assembly and the attached pouring spout to the opened valved position while maintaining the communication between the spout and the receptacle;

c) dispensing fluid to the receptacle from said container by tilting the container to the pouring position as to funnel fluid through the valve assembly and said spout;

d) terminating the dispensing of the fluid from said container by implementing at least one subsequent step comprising:

1) readjusting the container so that fluid level within the container rests below the valve assembly and thereby terminate funneling of the fluid through the valve assembly;

2) repositioning the container so as to cause the pivotal movement of the valved assembly and the attached pouring spout to be positioned at the closed valved position; and 3) stopping the venting of air through the air vent.

2. The method according to claim 1 wherein the container includes a grooved channel recessing within the funneled sidewall section and two fluid exiting ports oppositely positioned along said channel at a confluent flow position, and the tubular conduit bridges across the channel and communicates onto the exiting ports, said method includes terminating the fluid flow by the tilting of the container so as to position the fluid container within the container at a level below the exiting ports.

3. The method according to claim 1 wherein the valve assembly upon the pivotal movement of the pouring spout over a pouring spout positioning arc ranging from about 160 to about 200 radial degrees places the valved assembly at the open valved position and the method includes the pivoting of the valved assembly to said open valved position and thereafter readjusting the valved assembly to the closed position, terminate the flow of the fluid therethrough.

4. The method according to claim 1 which includes terminating the dispensing of the fluid by stopping the venting of air through the air vent.

5. The method according to claim 1 wherein the method for dispensing the fluid includes pivoting the valved assembly to the open valved position and a positioning the container so that the fluid is funneled to said discharging ports at a controlled discharging rate.

6. A fluid dispensing container for pouring a fluid contained within the container and equipped to control the fluid dispensed from the container, said container comprising an enclosed body for containing the fluid within the container with said body including a funneled sidewall section projecting upwardly and outwardly at an angular position so as to permit tunneling of the fluid within the funneled sidewall section when the container is adjusted to a pouring position, a valved assembly communicating onto said funneled sidewall section, an axial mount mounted along an upper region of the funneled sidewall section for pivotally mounting the valved assembly to the sidewall section, with said assembly responsively controlling fluid flowing through the assembly by a pivotal movement of the valved assembly to an opened valved position which allows for the fluid to flow through to assembly and by the pivotal movement of the assembly to a closed valved position which terminates the fluid flow through the valved assembly and a pouring spout affixed to said valved assembly for dispensing the fluid discharged from said valved assembly.

7. The container according to claim 6 wherein the container includes multiple fluid discharging ports for discharging fluid from the funneled sidewall section at a confluent flow position when tipping said container to the pouring position.

8. The container according to claim 7 wherein a tubular conduit provides the axial mount lot mounting the valved assembly and the attached pouring spout to the funneled sidewall section, with the conduit including a slotted orifice for discharging fluids from the conduit upon the pivotal movement of the pouring spout along a discharging arc ranging from about 160 to about 200 radial degrees.

9. The container according to claim 6 wherein the valved assembly includes a conduit for discharging the fluids through the upper region of the funneled sidewall section when the container is adjusted to the pouring position so as to funnel fluids through said conduit, with said conduit further serving as the axial mount for the pivotally mounting of said assembly to the sidewall section.

10. The container according to claim 9 wherein the conduit includes a slotted orifice for discharging fluids through said conduit and said valved assembly being positioned in the open valved position upon the pivotal movement of the pouring spout over a pouring arc ranging from about 160 to about 200 radial degrees.

11. The container according to claim 10 wherein the assembly includes a concentric housing securely attached to the pouring spout for pivotally mounting the assembly and attached pouring spout to said conduit.

12. The container according to claim 11 wherein the concentric housing includes a fluid inletting orifice of a smaller dimensional size than the slotted orifice.

13. The container according to claim 1 wherein the funneled sidewall section includes a grooved channel recessing within the funneled sidewall section.

14. The container according to claim 13 wherein the channel is sized so as to accommodate the pouring spout when said valved assembly and the affixed pouring spout is pivotally adjusted within the channel.

15. The container according to claim 13, wherein the channel includes two fluid discharging ports oppositely positioned along said channel for discharging the fluid funneled from the upper region of said funneled sidewall section.

16. The container according to claim 15, wherein the valved assembly includes a tubular conduit bridging the channel at the upper region of the sidewall section and porting onto the discharging ports.

17. The container according to claim 16 wherein the tubular conduit includes an exiting port for discharging the fluids from the tubular conduit.

18. The container according to claim 16 wherein the valved assembly includes a concentric housing enveloping and axially mounted onto said tubular conduit with said concentric housing including an apertured inletting opening which, upon the pivotal movement of the valved assembly to the opened valved position, places the inletting opening in alignment with the exiting port and thereby permits fluid to flow through the spout and upon the pivotal movement of the valved assembly to the closed valved position seats a solid segment of the housing against the exiting port and closes the exiting port to the flow of the fluid.

19. A dispensing container in which a flow of a fluid poured from the dispensing container may be controlled by a positional movement of a pouring spout and the container to a pouring position, said container comprising a hollow body portion having a bottom wall, a top wall and a sidewall defining an enclosure for containing the fluid within the container, said sidewall including a funneled sidewall section projecting upwardly and outwardly from the bottom wall at an angular position for funneling the fluid through an upper region of the sidewall to the pouring spout when the container is tilted towards said funneled sidewall section, and wherein the funneled sidewall section includes a recessed channel with the spout pivotally mounted within said recessed channel at a confluent fluid flow position, a valve assembly housed within said pouring spout for controlling fluid flowing within said spout, with said valve assembly including a valve responsively interconnected to said spout so that fluid flowing through said spout may be responsively controlled by the pivotal movement of said spout, fluid discharging ports oppositely positioned along said channel at the confluent flow position when said container is positioned in the pouring position by tilting the container towards the funneled sidewall section, a tubular conduit equipped with a discharging orifice bridging between the ports and open to the flow of the fluid therethrough from the body portion, a pouring spout equipped with a concentric tube axially and pivotally mounted onto the tubular conduit so as to permit the pivotal movement of the pouring spout about the conduit, with said concentric tube including a slotted outletting orifice which mates onto the discharging orifice upon the pivotal movement of the spout to an open valved fluid discharging position and a stopping of the fluid flowing therefrom upon the pivotal movement of the spout to the closed valved position.

20. The container according to claim 19 wherein the tubular conduit and the discharging ports are sized so as to permit a substantially uniform flow of the fluid from the container when the container containing the fluid is positioned at the confluent flow position, the slotted outletting orifice permits the discharging of the fluids through the discharging orifice upon the pivotal movement of the pouring spout over a pouring arc ranging from about 160 to about 200 radial degrees, and the container includes an air vent porting onto the top wall for venting air into the body portion while discharging the fluid from said container.

* * * * *